US012766577B2

(12) United States Patent
Wang et al.

(10) Patent No.: US 12,766,577 B2
(45) Date of Patent: Oct. 20, 2026

(54) ROLLING DEVICE AND ROLLING SYSTEM

(71) Applicant: CONTEMPORARY AMPEREX TECHNOLOGY (HONG KONG) LIMITED, Hong Kong (CN)

(72) Inventors: Yong Wang, Ningde (CN); Huan Che, Ningde (CN); Yalong Qing, Ningde (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 329 days.

(21) Appl. No.: 18/416,891

(22) Filed: Jan. 19, 2024

(65) Prior Publication Data

US 2024/0157420 A1 May 16, 2024

Related U.S. Application Data

(63) Continuation of application No. PCT/CN2022/120302, filed on Sep. 21, 2022.

(30) Foreign Application Priority Data

Nov. 25, 2021 (CN) ..... 202122926552.3

(51) Int. Cl.
*B21B 37/16* (2006.01)

(52) U.S. Cl.
CPC ..... *B21B 37/165* (2013.01)

(58) Field of Classification Search
CPC ... B21B 27/10; B21B 27/06; B21B 2027/103; B21B 37/32; B21B 37/74; B21B 2267/12
See application file for complete search history.

(56) References Cited

U.S. PATENT DOCUMENTS 3,990,284 A * 11/1976 Barten ..... G01J 5/0022 72/8.5
6,498,324 B2 * 12/2002 Yamamoto ..... B21B 37/32 219/661

(Continued)

FOREIGN PATENT DOCUMENTS

CN 102527727 A 7/2012
CN 208853454 U 5/2019

(Continued)

OTHER PUBLICATIONS

Extended European Search Report issued Sep. 19, 2024 in European Patent Application No. 22897333.5.

(Continued)

*Primary Examiner* — Matthew Katcoff
(74) *Attorney, Agent, or Firm* — XSENSUS LLP

(57) ABSTRACT

A rolling device includes a roller, a heat exchange assembly, and an adjustment assembly. The roller is provided with a rolling surface configured to roll a target member. The heat exchange assembly is arranged opposite to the rolling surface. The heat exchange assembly is configured to adjust the temperature of the rolling surface. The adjustment assembly is connected to the heat exchange assembly and is configured to adjust the position of the heat exchange assembly in an axial direction of the roller, so as to adjust temperatures of different regions of the rolling surface of the roller in the axial direction. A rolling system includes the rolling device, a measurement device and a controller, the measurement device is configured to measure the thickness of the target member after rolling; and the controller is connected in communication with the measurement device and the adjustment assembly.

20 Claims, 4 Drawing Sheets

(56) References Cited

U.S. PATENT DOCUMENTS

| | | | | |
|---|---|---|---|---|
| 6,598,448 | B1 * | 7/2003 | Barten | B21B 37/32 72/236 |
| 2021/0213503 | A1 | 7/2021 | Park et al. | |

FOREIGN PATENT DOCUMENTS

| | | | |
|---|---|---|---|
| CN | 110355210 | A | 10/2019 |
| CN | 214919229 | U | 11/2021 |
| CN | 216226141 | U | 4/2022 |
| DE | 2349611 | A1 | 4/1975 |
| DE | 2743130 | A1 | 6/1978 |
| EP | 1222973 | A2 | 7/2002 |
| JP | S56-126014 | A | 10/1981 |
| JP | H05-50122 | A | 3/1993 |

OTHER PUBLICATIONS

International Search Report and Written Opinion mailed on Dec. 22, 2022, received for PCT Application PCT/CN2022/120302, filed on Sep. 21, 2022, 17 pages including English Translation.
Notice of Grant mailed on Mar. 3, 2022 received for CN Application 202122926552.3, 2 pages including English Translation.

* cited by examiner

ROLLING DEVICE AND ROLLING SYSTEM

CROSS-REFERENCE TO RELATED APPLICATIONS

The present application is a continuation of International Application No. PCT/CN2022/120302, filed Sep. 21, 2022, which claims priority to Chinese Patent Application (No.: 202122926552.3), entitled with "ROLLING DEVICE AND ROLLING SYSTEM" and filed on Nov. 25, 2021, the disclosure of each of which is incorporated herein by reference in its entirety.

TECHNICAL FIELD

The present application relates to the field of rolling manufacturing, and in particular, to a rolling device and a rolling system.

BACKGROUND

Power batteries are widely used in the field of new energy, such as electric vehicles and new energy vehicles. The new energy vehicles and the electric vehicles have become a new trend in the development of the automobile industry. In a production process of power batteries, electrode plates need to be rolled. At present, the thickness consistency of a rolled electrode plate is poor, resulting in poor performance and consistency of a power battery.

SUMMARY OF THE DISCLOSURE

Embodiments of the present application aim to provide a rolling device and a rolling system, so as to improve the problem of the poor thickness consistency of a rolled electrode plate in related art.

In a first aspect, the embodiments of the present application provide a rolling device. The rolling device includes a roller, a heat exchange assembly, and an adjustment assembly. The roller is provided with a rolling surface configured to roll a target member. The heat exchange assembly is arranged opposite to the rolling surface. The heat exchange assembly is configured to adjust the temperature of the rolling surface. The adjustment assembly is connected to the heat exchange assembly. The adjustment assembly is configured to adjust the position of the heat exchange assembly in an axial direction of the roller.

In the above technical solution, the rolling device adjusts the position of heat exchange assembly in the axial direction of the roller through the set adjustment assembly, so that the heat exchange assembly adjusts temperatures of different regions of the rolling surface of the roller in the axial direction. According to the principle of thermal expansion and cold contraction, the different regions of the rolling surface in the axial direction expand under heat or contract under cold, so that the roll gap (the gap formed between two rollers located on two sides of the target member and configured to be in contact with the target member, which can also be understood as a clearance between the two rollers cooperating with each other to roll the target member) in the axial direction of the roller is consistent in size during rolling, so as to improve the thickness consistency of the target member and improve the performance and consistency of a power battery.

As an optional technical solution of the embodiments of the present application, the heating assembly includes a heating member. The heating member is arranged opposite to the rolling surface. The heating member is connected to the adjustment assembly, and the adjustment assembly is configured to adjust the position of the heating member in the axial direction.

In the above technical solution, the heating member can heat the rolling surface, so that the rolling surface expands because a local temperature of the rolling surface rises, and a relatively large roll gap is narrowed to be consistent with another roll gap in size. The adjustment assembly can adjust the position of the heating member in the axial direction, so that the heating member heats different regions of the rolling surface in the axial direction, so as to adjust the size of the roll gap corresponding to the plurality of different regions. Therefore, the size of the roll gap in the axial direction tends to be consistent, so as to improve the thickness consistency of the target member after rolling and improve the performance and consistency of the power battery.

As an optional technical solution of the embodiments of the present application, the heat exchange assembly includes a cooling member. The cooling member is arranged opposite to the rolling surface. The cooling member is connected to the adjustment assembly. The adjustment assembly is configured to adjust the position of the cooling member in the axial direction.

In the above technical solution, the cooling member can cool the rolling surface, so that the rolling surface contracts because a local temperature of the rolling surface drops, and a relatively small roll gap is expanded to be consistent with another roll gap in size. The adjustment assembly can adjust the position of the cooling member in the axial direction, so that the cooling member cools different regions of the rolling surface in the axial direction, so as to adjust the size of the roll gap corresponding to the plurality of different regions. Therefore, the size of the roll gap in the axial direction tends to be consistent, so as to improve the thickness consistency of the target member after rolling and improve the performance and consistency of the power battery.

As an optional technical solution of the embodiments of the present application, the heat exchange assembly includes a plurality of cooling members. The plurality of cooling members correspond to a plurality of regions of the rolling surface in the axial direction. Each cooling member is configured to separately adjust the temperature of one region.

In the above technical solution, by setting the plurality of cooling members, the temperatures of the plurality of different regions of the rolling surface in the axial direction can be adjusted at one time, which meets temperature adjustment requirements of the plurality of different regions, further improving the thickness consistency of the target member and improving the performance and consistency of the power battery.

As an optional technical solution of the embodiments of the present application, the cooling member is configured to spray a cooling medium to the rolling surface to adjust the temperature of the rolling surface.

In the above technical solution, the temperature of the rolling surface is adjusted by spraying the cooling medium. On the one hand, the cooling efficiency is high; and on the other hand, the cooling medium can scour the rolling surface, so that impurities adhered on the rolling surface are separated from the rolling surface to achieve an effect of cleaning the rolling surface. Therefore, the rolling surface is clean and free of debris, which avoids debris, reduces the size of the roll gap corresponding to a position where the debris is located, is beneficial to the size consistency of the roll gap in the axial direction of the roller, and is conductive to improving the thickness consistency of the target member.

As an optional technical solution of the embodiments of the present application, the rolling device further includes a dust removal mechanism. The dust removal mechanism is arranged opposite to the rolling surface.

In the above technical solution, by the arrangement of the dust removal mechanism, it is convenient to remove the impurities separated from the rolling surface, so as to reduce the possibility that the impurities separated from the rolling surface is adhered to the rolling surface again.

As an optional technical solution of the embodiments of the present application, the dust removal mechanism and the cooling member are arranged on the same side of the roller.

In the above technical solution, since the dust removal mechanism and the cooling member are arranged on the same side, it is beneficial for the dust removal mechanism to clear away the impurities washed down by the cooling medium, thereby improving the dust removal effect of the dust removal mechanism.

As an optional technical solution of the embodiments of the present application, the adjustment assembly includes a guide member and a driving member; the guide member extends in the axial direction of the roller; the heat exchange assembly is movably connected to the guide member; the driving member is in driving connection with the heat exchange assembly; and the driving member is configured to drive the heat exchange assembly to move along the guide member.

In the above technical solution, the guide member can play a guide role and restrict the movement of the heat exchange assembly in a direction deviating from the axial direction of the roller, so that the heat exchange assembly can move in the axial direction, so as to ensure that the heat exchange assembly exchanges heat with the different regions of the rolling surface in the axial direction. By the arrangement of the driving member, it is convenient to drive the heat exchange assembly to move along the guide member, so as to adjust the position of the heat exchange assembly in the axial direction of the roller.

As an optional technical solution of the embodiments of the present application, the heat exchange assembly is provided with a heat exchange surface. The heat exchange surface is opposite to the rolling surface. The heat exchange surface is an arc surface. The heat exchange surface and the roller are coaxially arranged.

In the above technical solution, since the rolling surface is a circumferential surface, the heat exchange surface is set to be the arc surface to match the rolling surface. In addition, the heat exchange surface and the roller are coaxially arranged. On the one hand, contact between the heat exchange surface and the rolling surface can be avoided. On the other hand, a relative area between the heat exchange surface and the rolling surface is large, and distances between all parts are equal. The heat exchange surface can better exchange heat with the rolling surface to prevent the influence on the adjustment effect of the roll gap due to non-uniform heating of the rolling surface.

In a second aspect, the embodiments of the present application further provide a rolling system. The rolling system includes the above-mentioned rolling device, a measurement device, and a controller. The measurement device is configured to measure the thickness of the target member after rolling. The controller is connected in communication with the measurement device and the adjustment assembly. The controller is configured to control the adjustment assembly according to a measured value of the measurement device and adjust the position of the heat exchange assembly in the axial direction of the roller, so that the heat exchange assembly adjusts temperatures of different regions of the rolling surface in the axial direction.

As an optional technical solution of the embodiments of the present application, the rolling system further includes a temperature detection device. The temperature detection device is connected in communication with the controller. The temperature detection device is configured to detect the temperatures of different regions of the rolling surface in the axial direction. The controller is configured to control the adjustment assembly according to the measured value of the measurement device and a detected value of the temperature detection device to adjust the position of the heat exchange assembly in the axial direction of the roller, so that the heat exchange assembly adjusts the temperatures of different regions of the rolling surface in the axial direction.

In the above technical solution, by the arrangement of the temperature detection device, the temperatures of different regions of the rolling surface in the axial direction are detected, and the detected value is sent to the controller, so that the entire system forms negative feedback adjustment, which is beneficial to control a degree of thermal expansion and cold contraction of the different regions of the rolling surface to make the thickness consistency of the target member better.

BRIEF DESCRIPTION OF THE DRAWINGS

For clearer descriptions of the technical solutions of the embodiments of the present application, the drawings required to be used in the embodiments are briefly introduced below. It should be understood that the drawings below are only some embodiments of the present application. Therefore, the embodiments shall not be regarded as limitations on the scope. A person of ordinary skill in the art can also obtain other relevant drawings according to these drawings without creative work.

Figure 1:
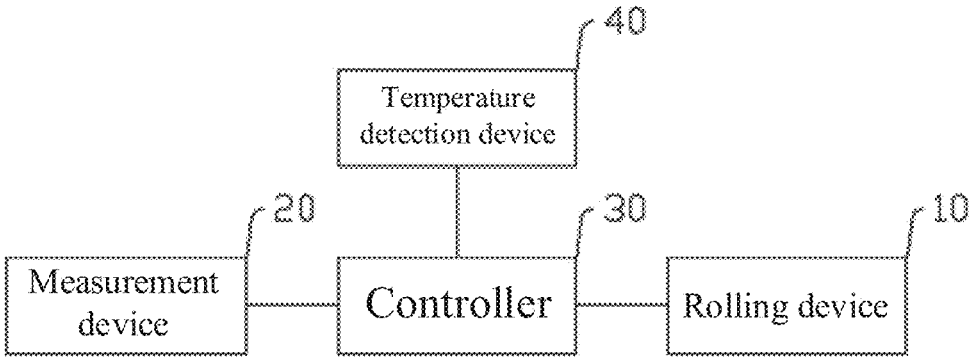
FIG. 1 is a schematic diagram of a rolling system according to some embodiments of the present application.

Numerals: 10—rolling device; 20—measurement device; 30—controller; 40—temperature detection device; 100—roller; 110—rolling surface; 200—heat exchange assembly; 210—heating member; 211—heat exchange surface; 220—cooling member; 221—spray head; 2211—nozzle; 300—adjustment assembly; 400—dust removal mechanism; and 500—target member.

DETAILED DESCRIPTIONS

The embodiments of the technical solutions of the present application are described in detail in combination with the accompanying drawings below. The following embodiments are only configured to more clearly illustrate the technical solutions of the present application, and therefore are only used as examples and cannot be configured to limit the scope of protection of the present application.

Unless otherwise defined, all technical and scientific terms used herein have the same meaning as commonly understood by those skilled in the art of the present application. The terms used herein are intended only for the purpose of describing specific embodiments and are not intended to limit the present application. The terms "include" and "has/have", as well as any variations thereof, in the specification and claims of the present application, as well as the accompanying drawings, are intended to encompass non-exclusive inclusion.

In the description of the embodiments of the present application, the technical terms "first", "second", and the like are only for distinguishing different objects, and may not be understood as indicating or implying the relative importance or implicitly indicating the number, specific order or primary and secondary relations of the technical features indicated. In the description of the embodiments of the present application, "plurality" means more than two, unless otherwise expressly and specifically defined.

Reference to "an embodiment" herein means that a particular feature, structure or characteristic described in conjunction with an embodiment may be included in at least one embodiment of the present application. The phrase shown in various locations in the specification may not necessarily refer to the same embodiment, and is not an independent or optional embodiment exclusive from another embodiment. It is explicitly and implicitly understood by those skilled in the art that the embodiments described herein may be combined with other embodiments.

In the descriptions of the embodiments of the present application, the term "and/or" only describes an association relation of associated objects and represents that three relations may exist. For example, A and/or B may represent three situations: A exists alone; A and B exist simultaneously; and B exists alone. In addition, the character "/" herein usually indicates an "or" relation between associated objects.

In the descriptions of the embodiments of the present application, the term "plurality" refers to more than two (including two), and similarly, "a plurality of groups" refers to more than two groups (including two groups); and "a plurality of sheets" refers to more than two sheets (including two sheets).

In the descriptions of the embodiments of present application, orientations or positional relationships indicated by the technical terms "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial", "circumferential" and the like are orientations or positional relationships as shown in the drawings, and are only for the purpose of facilitating and simplifying the descriptions of the embodiments of the present application instead of indicating or implying that devices or elements indicated must have particular orientations, and be constructed and operated in the particular orientations, so that these terms are not construed as limiting the embodiments of the present application.

In the descriptions of the embodiments of the present application, unless otherwise expressly specified and limited, the technical terms "mount," "connect", "connection", "fix" and the like should be understood in a broad sense, such as, a fixed connection, a detachable connection, an integrated connection, a mechanical connection, an electrical connection, a direct connection, an indirect connection through an intermediate medium, an internal communication of two elements, or interaction between two elements. Those of ordinary skill in the art can understand the specific meanings of the above terms in the embodiments of the present application according to specific situations.

At present, from the perspective of the development of the market situation, power batteries are more and more widely used. The power batteries are used in energy storage power source systems such as hydraulic, thermal, wind, and solar power stations, and are widely applied to electric vehicles such as such as electric bicycles, electric motorcycles, electric automobiles, and many fields such as military equipment and aerospace. With the continuous expansion of the application field of the power batteries, the market demand is also constantly increasing.

In a production process of power batteries, electrode plates need to be rolled. At present, the thickness consistency of a rolled electrode plate is poor, resulting in poor performance and consistency of a power battery.

The inventor has found through studies that there are errors in the manufacturing accuracy of rollers in the related art, so that during rolling, the roll gap (the gap formed between two rollers located on two sides of a target member and configured to be in contact with the target member, which can also be understood as a clearance between the two rollers cooperating with each other to roll the target member) in an axial direction of a roller is inconsistent in size. The roll gap of a certain section is relatively large, and the roll gap of another section is relatively small. In this way, in the axial direction of the roller, the thickness of the rolled electrode plate will also change correspondingly, that is, the part with the relatively large roll gap corresponds to the electrode plate with the relatively large thickness, and the part with the relatively small roll gap corresponds to the electrode plate with the relatively small thickness. Thus, the thickness consistency of the rolled electrode plate is poor.

Based on the above considerations, the inventor has designed a rolling device via deep studies. The rolling device adjusts the position of a heat exchange assembly in the axial direction of the roller through setting an adjustment assembly, so that the heat exchange assembly adjusts temperatures of different regions of a rolling surface of the roller in the axial direction. According to the principle of thermal expansion and cold contraction, the different regions of the rolling surface in the axial direction expand under heat or contract under cold, so that the roll gap in the axial direction of the roller is consistent in size during rolling, so as to improve the thickness consistency of the target member.

The rolling device disclosed in the embodiments of the present application can be configured to roll a target member including but not limited to an electrode plate, a film, a plastic member, a metal foil, and the like. Rolling can be completed by using the rolling device disclosed in the present application or a rolling system provided with the rolling device disclosed in the present application, so as to improve the thickness consistency of the target member.

Figure 2:
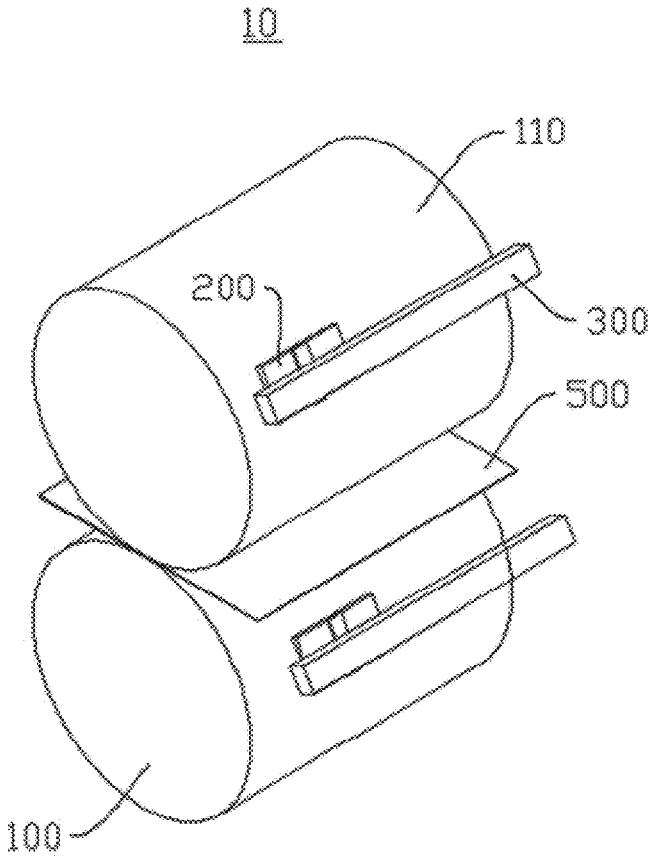
FIG. 2 is a schematic diagram of a structure of a rolling device according to some embodiments of the present application.

Referring to FIG. 1 and FIG. 2, FIG. 1 is a schematic diagram of a rolling system according to some embodiments of the present application. FIG. 2 is a schematic diagram of a structure of a rolling device 10 according to some embodiments of the present application. The embodiments of the present application provides a rolling system. The rolling system includes a rolling device 10, a measurement device 20, and a controller 30. The measurement device 20 is configured to measure the thickness of a target member 500 after rolling. The rolling device 10 includes a roller 100, a heat exchange assembly 200, and an adjustment assembly 300. The roller 100 is provided with a rolling surface 110 configured to roll the target member 500. The heat exchange assembly 200 is arranged opposite to the rolling surface 110. The heat exchange assembly 200 is configured to adjust the temperature of the rolling surface 110. The adjustment assembly 300 is connected to the heat exchange assembly 200. The adjustment assembly 300 is configured to adjust the position of the heat exchange assembly 200 in an axial direction of the roller 100. The controller 30 is connected in communication with the measurement device 20 and the adjustment assembly 300. The controller 30 is configured to control the adjustment assembly 300 according to a measured value of the measurement device 20 and adjust the position of the heat exchange assembly 200 in the axial direction of the roller 100, so that the heat exchange assembly 200 adjusts temperatures of different regions of the rolling surface 110 in the axial direction.

The rolling device 10 is a structure for rolling the target member 500, so that the target member 500 is rolled to a preset thickness. The rolling device 10 adjusts the position of heat exchange assembly 200 in the axial direction of the roller 100 through the adjustment assembly 300, so that the heat exchange assembly 200 adjusts temperatures of different regions of the rolling surface 110 of the roller 100 in the axial direction. According to the principle of thermal expansion and cold contraction, the different regions of the rolling surface 110 in the axial direction expand under heat or contract under cold, so that the roll gap (the gap formed between two rollers 100 located on two sides of the target member 500 and configured to be in contact with the target member 500, which can also be understood as a clearance between the two rollers 100 cooperating with each other to roll the target member 500) in the axial direction of the roller 100 is consistent in size during rolling, so as to improve the thickness consistency of the target member 500 and improve the performance and consistency of a power battery.

The measurement device 20 is a structure having a length measurement function. The measurement device 20 is configured to measure the thickness of the target member 500 after rolling, thus determining a relatively large or small position of the roll gap. For example, when it is measured that the thickness of a middle portion of the target member 500 after rolling is relatively large, it indicates that a middle region of the roll gap is relatively large, and heating is required to narrow the roll gap. When it is measured that the thickness of an edge of the target member 500 after rolling is relatively small, it indicates that an edge region of the roll gap is relatively small, and cooling is required to expand the roll gap.

The controller 30 is a processing unit with information processing and program running functions, such as a central processing unit (CPU)) and a programmable logic controller (PLC). The controller 30 can receive the measured value of the measurement device 20 to control actions of the adjustment assembly 300, so that the adjustment assembly 300 adjusts the position of the heat exchange assembly 200 in the axial direction of the roller 100, and the heat exchange assembly 200 is opposite to the different regions of the rolling surface 110 in the axial direction, to change the temperatures of different regions of the rolling surface 110 in the axial direction. According to the principle of thermal expansion and cold contraction, the different regions of the rolling surface 110 in the axial direction expand under heat or contract under cold, so that the roll gap in the axial direction of the roller 100 is consistent in size during rolling, so as to improve the thickness consistency of the target member 500 and improve the performance and consistency of the power battery.

When the rolling system is used for the first time, through the measurement of the measurement device 20 and the control of the controller 30, it can be determined how the adjustment assembly 300 should adjust the position of the heat exchange assembly 200 at a certain moment of the roller 100. Furthermore, during the subsequent use, the controller 30 can directly adjust the position of the adjustment assembly 300 according to a first control record, so that the thickness of the rolled target member 500 is uniform. In short, through preliminary debugging performed on the rolling system, the controller 30 can record when to control the adjustment assembly 300 to adjust the position of the heat exchange assembly 200. During subsequent use, control can be performed according to a record of the controller 30, so that the thickness consistency of a subsequently rolled electrode plate is good.

In some embodiments of the present application, the rolling system further includes a temperature detection device 40. The temperature detection device 40 is connected in communication with the controller 30. The temperature detection device 40 is configured to detect the temperatures of different regions of the rolling surface 110 in the axial direction. The controller 30 is configured to control the adjustment assembly 300 according to a measured value of the measurement device 20 and a detected value of the temperature detection device 40 and adjust the position of the heat exchange assembly 200 in the axial direction of the roller 100, so that the heat exchange assembly 200 adjusts the temperatures of different regions of the rolling surface 110 in the axial direction.

The temperature detection device 40 is a structure having a temperature measurement function. The temperature detection device 40 may be a thermocouple thermometer, a bimetal thermometer, a temperature gun, and the like, which is not limited in the embodiments of the present application. The temperature detection device 40 is configured to detect the temperatures of different regions of the rolling surface 110 in the axial direction, so as to provide a basis for whether the controller 30 controls the heat exchange assembly 200 to continue to exchange heat with a corresponding region.

By the arrangement of the temperature detection device 40, the temperatures of different regions of the rolling surface 110 in the axial direction are detected, and the detected value is sent to the controller 30, so that the entire system forms negative feedback adjustment, which is beneficial to control a degree of thermal expansion and cold contraction of the different regions of the rolling surface 110 to make the thickness consistency of the target member 500 better.

Referring to FIG. 2, some embodiments of the present application provide a rolling device 10. The rolling device 10 includes a roller 100, a heat exchange assembly 200, and an adjustment assembly 300. The roller 100 is provided with a rolling surface 110 configured to roll the target member 500. The heat exchange assembly 200 is arranged opposite to the rolling surface 110. The heat exchange assembly 200 is configured to adjust the temperature of the rolling surface 110. The adjustment assembly 300 is connected to the heat exchange assembly 200. The adjustment assembly 300 is configured to adjust the position of the heat exchange assembly 200 in an axial direction of the roller 100.

The roller 100 is a component that makes a target member 500 to generate continuous plastic deformation. The roller 100 is generally cylindrical, a circumferential surface of which includes a rolling surface 110 for rolling the target member 500.

The heat exchange assembly 200 is a structure capable of exchanging heat with another component to change temperatures of the another component. In the embodiments of the present application, the heat exchange assembly 200 is configured to exchange heat with the rolling surface 110 to change the temperature of the rolling surface 110, including both heating the rolling surface 110 to increase the temperature of the rolling surface 110 and cooling the rolling surface 110 to decrease the temperature of the rolling surface 110.

The adjustment assembly 300 is a structure capable of driving another component to move. In the embodiments of the present application, the adjustment assembly 300 is configured to drive the heat exchange assembly 200 to move relative to the roller 100 in the axial direction of the roller 100, so as to change the position of the heat exchange assembly 200 in the axial direction of the roller 100.

The rolling device 10 adjusts the position of heat exchange assembly 200 in the axial direction of the roller 100 through the adjustment assembly 300, so that the heat exchange assembly 200 adjusts temperatures of different regions of the rolling surface 110 of the roller 100 in the axial direction. According to the principle of thermal expansion and cold contraction, the different regions of the rolling surface 110 in the axial direction expand under heat or contract under cold, so that the roll gap (the gap formed between two rollers 100 located on two sides of the target member 500 and configured to be in contact with the target member 500, which can also be understood as a clearance between the two rollers 100 cooperating with each other to roll the target member 500) in the axial direction of the roller 100 is consistent in size during rolling, so as to improve the thickness consistency of the target member 500 and improve the performance and consistency of a power battery.

A quantity of the roller 100 in the rolling device 10 is not limited. For example, referring to FIG. 2, there are two rollers 100. In some embodiments of the present application, a quantity of the roller 100 may also be one. In this case, the roll gap is a clearance between the roller 100 and a workbench that supports the target member 500. Of course, the quantity of the roller 100 may also be three or more. In this case, one roller 100 cooperates with a plurality of rollers 100 to form a plurality of roll gaps, and a quantity of the adjustment assembly 300 and a quantity of the heat exchange assembly 200 can be increased correspondingly according to a quantity of the roll gap, so as to complete adjustment of the consistencies of the plurality of roll gaps.

Figure 3:
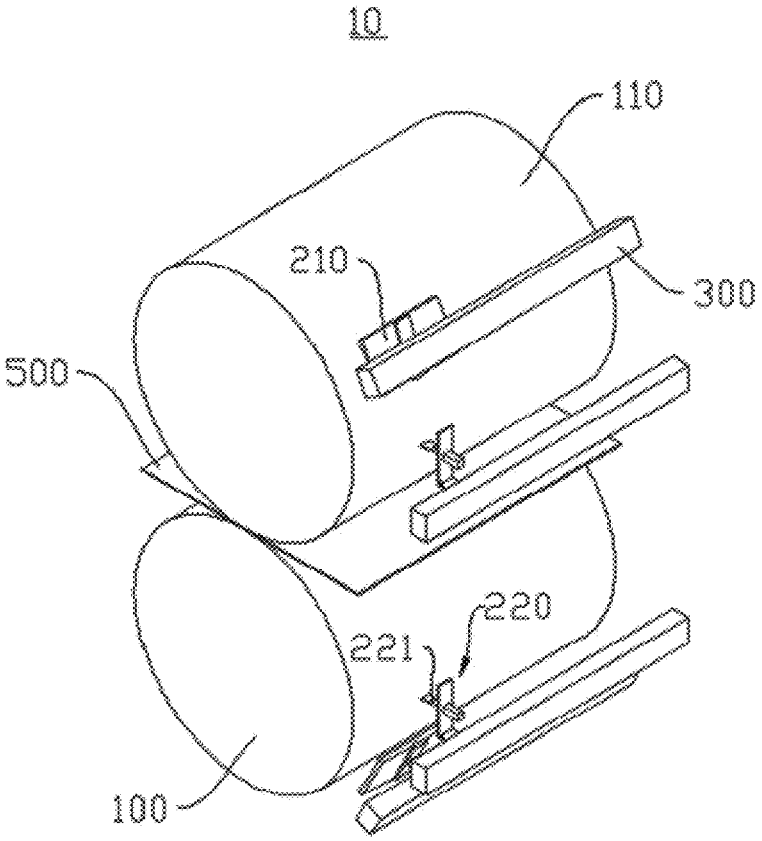
FIG. 3 is a schematic diagram of a structure of a rolling device according to some other embodiments of the present application.

Referring to FIG. 3, FIG. 3 is a schematic diagram of a structure of a rolling device 10 according to some embodiments of the present application. In some other embodiments of the present application, the heat exchange assembly 200 includes a heating member 210. The heating member 210 is arranged opposite to the rolling surface 110, and the heating member 210 is connected to the adjustment assembly 300. The adjustment assembly 300 is configured to adjust the position of the heating member 210 in an axial direction.

The heating member 210 is a component configured to heat another component to increase the temperature of the another component. In the embodiments of the present application, the heating member 210 is configured to heat the rolling surface 110 to increase the temperature of the rolling surface 110. The heating member 210 may be a resistance heating member, an infrared heating member, an electromagnetic induction heating member, or the like, which is not limited in the embodiments of the present application. The electromagnetic induction heating member has the advantages of high heating efficiency and good controllability, which is conducive to heating a concave region of the rolling surface 110 to expand the concave region, so that the roll gap in the axial direction of the roller 100 is consistent in size.

The heating member 210 can heat the rolling surface 110, so that the rolling surface 110 expands because a local temperature of the rolling surface rises, and a relatively large roll gap is narrowed to be consistent with another roll gap in size. The adjustment assembly 300 can adjust the position of the heating member 210 in the axial direction, so that the heating member 210 heats different regions of the rolling surface 110 in the axial direction, so as to adjust the size of the roll gap corresponding to the plurality of different regions. Therefore, the size of the roll gap in the axial direction tends to be consistent, so as to improve the thickness consistency of the target member 500 after rolling and improve the performance and consistency of the power battery.

In some embodiments of the present application, the heat exchange assembly 200 includes a plurality of heating members 210. The plurality of heating members 210 correspond to a plurality of regions of the rolling surface 110 in the axial direction, and each heating member 210 is configured to separately adjust the temperature of one region.

"Each heating member 210 is configured to separately adjust the temperature of one region" means that each heating member 210 can work independently. During working, the heating member 210 can heat a region of the rolling surface 110 opposite to the heating member 210.

By the arrangement of the plurality of heating members 210, the temperatures of the plurality of different regions of the rolling surface 110 in the axial direction can be adjusted at one time, which meets temperature adjustment requirements of the plurality of different regions, further improving the thickness consistency of the target member 500.

In some embodiments of the present application, the heat exchange assembly 200 includes a cooling member 220. The cooling member 220 is arranged opposite to the rolling surface 110, and the cooling member 220 is connected to the adjustment assembly 300. The adjustment assembly 300 is configured to adjust the position of the cooling member 220 in the axial direction.

The cooling member 220 is configured to cool another component to decrease the temperature of the another component. In the embodiments of the present application, the cooling member 220 is configured to cool the rolling surface 110 to decrease the temperature of the rolling surface 110.

The cooling member 220 can cool the rolling surface 110, so that the rolling surface 110 contracts because a local temperature of the rolling surface drops, and a relatively small roll gap is expanded to be consistent with another roll gap in size. The adjustment assembly 300 can adjust the position of the cooling member 220 in the axial direction, so that the cooling member 220 cools different regions of the rolling surface 110 in the axial direction, so as to adjust the size of the roll gap corresponding to the plurality of different regions. Therefore, the size of the roll gap in the axial direction tends to be consistent, so as to improve the thickness consistency of the target member 500 after rolling and improve the performance and consistency of the power battery.

Figure 4:
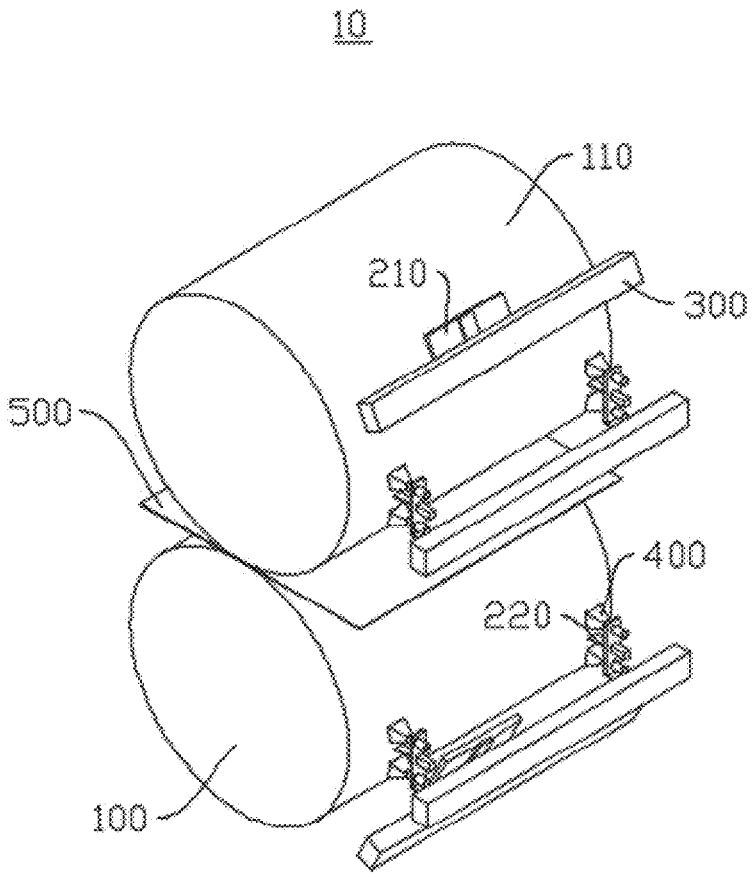
FIG. 4 is a schematic diagram of a structure of a rolling device according to still some embodiments of the present application.

Referring to FIG. 4, FIG. 4 is a schematic diagram of a structure of a rolling device 10 according to still some embodiments of the present application. In still some embodiments of the present application, the heat exchange assembly 200 includes a plurality of cooling members 220. The plurality of cooling members 220 correspond to a plurality of regions of the rolling surface 110 in the axial direction, and each cooling member 220 is configured to separately adjust the temperature of one region.

"Each cooling member 220 is configured to separately adjust the temperature of one region" means that each cooling member 220 can work independently. During working, the cooling member 220 can heat a region of the rolling surface 110 opposite to the cooling member 220.

By the arrangement of the plurality of cooling members 220, the temperatures of the plurality of different regions of the rolling surface 110 in the axial direction can be adjusted at one time, which meets temperature adjustment requirements of the plurality of different regions, improving the thickness consistency of the target member 500 while improving the adjustment efficiency.

In some embodiments of the present application, the cooling member 220 is configured to spray a cooling medium to the rolling surface 110 to adjust the temperature of the rolling surface 110.

The cooling medium includes but is not limited to liquid nitrogen, liquid carbon dioxide, dry ice particles, or the like.

The temperature of the rolling surface 110 is adjusted by spraying the cooling medium. On the one hand, the cooling efficiency is high; and on the other hand, the cooling medium can scour the rolling surface 110, so that impurities adhered on the rolling surface 110 are separated from the rolling surface 110 to achieve an effect of cleaning the rolling surface 110. Therefore, the rolling surface 110 is clean and free of debris, which avoids debris, reduces the size of the roll gap corresponding to a position where the debris is located, is beneficial to the size consistency of the roll gap in the axial direction of the roller 100, and is conductive to improving the thickness consistency of the target member 500.

Figure 5:
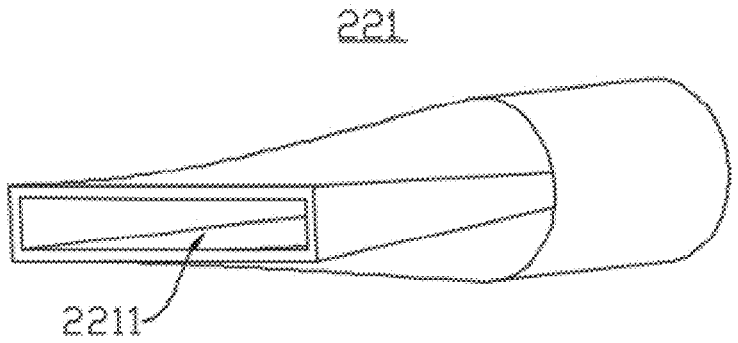
FIG. 5 is a schematic diagram of a structure of a cooling member according to some embodiments of the present application.

Referring to FIG. 4 and FIG. 5, FIG. 5 is a schematic diagram of a structure of a cooling member 220 according to some embodiments of the present application. In some embodiments of the present application, the cooling member 220 includes a spray head 221. The spray head 221 is provided with a nozzle 2211. The nozzle 2211 is of a flat mouth structure. Since the nozzle 2211 is set to be the flat mouth structure, concentrated injection can be achieved, so as to concentrate the cooling medium on a region opposite to the cooling member 220 and improve the cooling effect. Of course, the nozzle 2211 may also be round or square, which is not limited in the embodiments of the present application.

In some other embodiments of the present application, the cooling member 220 may also adjust the temperature of the rolling surface 110 by means of heat radiation.

In some embodiments of the present application, the rolling device 10 further includes a dust removal mechanism 400. The dust removal mechanism 400 is arranged opposite to the rolling surface 110.

The dust removal mechanism 400 is a mechanism for clearing away impurities near the rolling surface 110. The dust removal mechanism 400 may be a negative pressure dust removal mechanism or an electrostatic dust removal mechanism.

By the arrangement of the dust removal mechanism 400, it is convenient to remove the impurities separated from the rolling surface 110, so as to reduce the possibility that the impurities separated from the rolling surface 110 is adhered to the rolling surface 110 again.

During working, the dust removal mechanism 400 and the cooling member 220 are simultaneously turned on and simultaneously turned off. Of course, the dust removal mechanism 400 can also be turned on or turned off in a delayed manner as required.

In some embodiments of the present application, the dust removal mechanism 400 and the cooling member 220 are arranged on the same side of the roller 100.

"The dust removal mechanism 400 and the cooling member 220 are arranged on the same side of the roller 100" may also be understood as that a region of the rolling surface 110 opposite the dust removal mechanism 400 and a region of the rolling surface 110 opposite the cooling member 220 are the same region."

Since the dust removal mechanism 400 and the cooling member 220 are arranged on the same side, it is beneficial for the dust removal mechanism 400 to clear away the impurities washed down by the cooling medium, thereby improving the dust removal effect of the dust removal mechanism 400.

In some embodiments of the present application, one cooling member 220 is correspondingly provided with one dust removal mechanism 400. The dust removal mechanism 400 is connected to an upper side or a lower side of the cooling member 220 and moves together with the cooling member 220 under the action of the adjustment assembly 300. In some embodiments of the present application, one cooling member 220 is correspondingly provided with two dust removal mechanisms 400. The two dust removal mechanisms 400 are connected to an upper side and a lower side of the cooling member 220 respectively and simultaneously move together with the cooling member 220 under the action of the adjustment assembly 300.

In still some embodiments of the present application, the dust removal mechanism 400 is covered at the cooling member 220 to clear away impurities, washed down by the cooling medium, around the cooling member 220, which has a better dust removal effect.

In some embodiments of the present application, the adjustment assembly 300 includes a guide member and a driving member. The guide member extends in the axial direction of the roller 100, and the heat exchange assembly 200 is movably connected to the guide member. The driving member is in driving connection with the heat exchange assembly 200, and the driving member is configured to drive the heat exchange assembly 200 to move along the guide member.

The guide member is a component that has a guide effect. For example, the guide member may be a guide rod. For another example, the guide member may be a guide rail.

The driving member is a structure configured to provide a power source and drive another component to move, including but not limited to a cylinder, an electric cylinder, a hydraulic cylinder, a motor, and the like. In the embodiments of the present application, the driving member is configured to drive the heat exchange assembly 200 to move along the guide member, so as to adjust the position of the heat exchange assembly 200 in the axial direction of the roller 100.

The guide member can play a guide role and restrict the movement of the heat exchange assembly 200 in a direction deviating from the axial direction of the roller 100, so that the heat exchange assembly 200 can move in the axial direction, so as to ensure that the heat exchange assembly 200 exchanges heat with the different regions of the rolling surface 110 in the axial direction. By the arrangement of the driving member, it is convenient to drive the heat exchange assembly 200 to move along the guide member, so as to adjust the position of the heat exchange assembly 200 in the axial direction of the roller 100.

Figure 6:
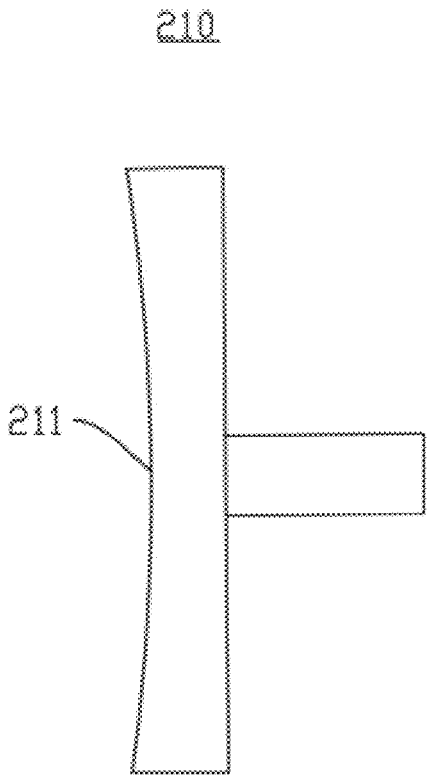
FIG. 6 is a schematic diagram of a structure of a heating member according to some embodiments of the present application.

Referring to FIG. 6, FIG. 6 is a schematic diagram of a structure of a heating member 210 according to some embodiments of the present application. In some embodiments of the present application, the heat exchange assembly 200 has a heat exchange surface 211, and the heat exchange surface 211 is opposite to the rolling surface 110. The heat exchange surface 211 is an arc surface, and the heat exchange surface 211 and the roller 100 are coaxially arranged.

The heat exchange surface 211 is a surface of the heat exchange assembly 200 mainly used for radiating heat. The arc surface refers to a surface with an arc-shaped cross section.

Since the rolling surface 110 is a circumferential surface, the heat exchange surface 211 is set to be the arc surface to match the rolling surface 110. In addition, the heat exchange surface 211 and the roller 100 are coaxially arranged. On the one hand, contact between the heat exchange surface 211 and the rolling surface 110 can be avoided. On the other hand, a relative area between the heat exchange surface 211 and the rolling surface 110 is large, and distances between all parts are equal. The heat exchange surface 211 can better exchange heat with the rolling surface 110 to prevent the influence on the adjustment effect of the roll gap due to non-uniform heating of the rolling surface 110.

Optionally, a distance between the heat exchange surface 211 and the rolling surface 110 is 5 mm-15 mm. When the distance between the heat exchange surface 211 and the rolling surface 110 is less than 5 mm, heat is too high and is hard to control. When the distance between the heat exchange surface 211 and the rolling surface 110 is greater than 15 mm, heat is too low, the heating efficiency is low, and the heating time is too long.

It should be noted that the heating member 210 and the cooling member 220 can work at the same time. For example, if a central region of the rolling surface 110 needs to be heated, and an edge region of the rolling surface 110 needs to be cooled, the adjustment assembly 300 can adjust the heating member 210 to the central region to heat the central region. Meanwhile, the adjustment assembly 300 can also adjust the cooling member 220 to the edge region to cool the edge region, so that the roll gap in the axial direction of the roller 100 is consistent in size, so as to improve the thickness consistency of the target member 500.

According to some embodiments of the present application, referring to FIG. 2 to FIG. 4, the rolling device 10 includes a roller 100, a heat exchange assembly 200, and an adjustment component 300. The roller 100 is provided with a rolling surface 110 for rolling a target member 500. The heat exchange assembly 200 is arranged opposite to the rolling surface 110. The heat exchange assembly 200 is configured to adjust the temperature of the rolling surface 110. The adjustment assembly 300 is connected to the heat exchange assembly 200. The adjustment assembly 300 is configured to adjust the position of the heat exchange assembly 200 in an axial direction of the roller 100. The heat exchange assembly 200 includes a heating member 210. The heating member 210 is arranged opposite to the rolling surface 110. The heating member 210 is connected to the adjustment assembly 300. The adjustment assembly 300 is configured to adjust the position of the heating member 210 in an axial direction. The heat exchange assembly 200 includes a cooling member 220. The cooling member 220 is arranged opposite to the rolling surface 110. The cooling member 220 is connected to the adjustment assembly 300. The adjustment assembly 300 is configured to adjust the position of the cooling member 220 in the axial direction. The cooling member 220 is configured to spray a cooling medium to the rolling surface 110 to adjust the temperature of the rolling surface 110.

The rolling device 10 can heat the rolling surface 110 through the heating member 210, so that the rolling surface 110 expands because a local temperature of the rolling surface rises, and a relatively large roll gap is narrowed to be consistent with another roll gap in size. The adjustment assembly 300 can adjust the position of the heating member 210 in the axial direction, so that the heating member 210 heats different regions of the rolling surface 110 in the axial direction, so as to adjust the size of the roll gap corresponding to the plurality of different regions. Therefore, the size of the roll gap in the axial direction tends to be consistent, so as to improve the thickness consistency of the target member 500 after rolling. The cooling member 220 can cool the rolling surface 110, so that the rolling surface 110 contracts because a local temperature of the rolling surface drops, and a relatively small roll gap is expanded to be consistent with another roll gap in size. The adjustment assembly 300 can adjust the position of the cooling member 220 in the axial direction, so that the cooling member 220 cools different regions of the rolling surface 110 in the axial direction, so as to adjust the size of the roll gap corresponding to the plurality of different regions. Therefore, the size of the roll gap in the axial direction tends to be consistent, so as to improve the thickness consistency of the target member 500 after rolling. The temperature of the rolling surface 110 is adjusted by spraying the cooling medium. On the one hand, the cooling efficiency is high; and on the other hand, the cooling medium can scour the rolling surface 110, so that impurities adhered on the rolling surface 110 are separated from the rolling surface 110 to achieve an effect of cleaning the rolling surface 110. Therefore, the rolling surface 110 is clean and free of debris, which avoids debris, reduces the size of the roll gap corresponding to a position where the debris is located, is beneficial to the size consistency of the roll gap in the axial direction of the roller 100, and is conductive to improving the thickness consistency of the target member 500.

It should be noted that in case of no conflicts, the multiple embodiments of the present application can be combined with each other.

It should be finally noted that: The foregoing embodiments are merely intended to describe the technical solutions of the present application, but not for limiting the present application. Although the present application is described in detail with reference to the foregoing embodiments, persons of ordinary skill in the art should understand that they may still make modifications to the technical solutions described in the foregoing embodiments or make equivalent replacements to part or all technical features thereof. These modifications or replacements do not make the essence of the corresponding technical solutions depart from the scopes of the technical solutions of the various embodiments of the present application, and shall fall within the scopes of the claims and the specification of the present application. In particular, the technical features mentioned in the various embodiments can be combined in any manner as long as there is no structural conflict. The present application is not limited to the specific embodiments disclosed herein, but includes all technical solutions falling within the scope of the claims.

What is claimed is:

1. A rolling device, comprising:

a roller, provided with a rolling surface configured to roll a target member;

a heat exchange assembly, arranged opposite to the rolling surface, wherein the heat exchange assembly includes both a heating member and a cooling member is configured to adjust the temperature of the rolling surface; and an adjustment assembly, connected to the heat exchange assembly, wherein the adjustment assembly is configured to adjust a position of the heat exchange assembly in an axial direction of the roller to adjust the heating member to at least one narrowed position to narrow a roll gap at the at least one narrowed position and to adjust the cooling member to at least one expansion position to expand a roll gap at the at least one expansion position to improve a thickness consistency of the target member.

2. The rolling device according to claim 1, wherein the heat exchange assembly comprises:

the heating member, arranged opposite to the rolling surface, wherein the heating member is connected to the adjustment assembly, and the adjustment assembly is configured to adjust the position of the heating member in the axial direction.

3. The rolling device according to claim 1, wherein the heat exchange assembly comprises:

the cooling member, arranged opposite to the rolling surface, wherein the cooling member is connected to the adjustment assembly, and the adjustment assembly is configured to adjust the position of the cooling member in the axial direction.

4. The rolling device according to claim 3, wherein the heat exchange assembly comprises:

a plurality of cooling members, corresponding to a plurality of regions of the rolling surface in the axial direction, wherein each of the cooling members is configured to separately adjust the temperature of one region.

5. The rolling device according to claim 3, wherein the cooling member is configured to spray a cooling medium to the rolling surface to adjust the temperature of the rolling surface.

6. The rolling device according to claim 5, wherein the rolling device further comprises a dust removal mechanism, and the dust removal mechanism is arranged opposite to the rolling surface.

7. The rolling device according to claim 6, wherein the dust removal mechanism and the cooling member are arranged on the same side of the roller.

8. The rolling device according to claim 1, wherein the adjustment assembly comprises a guide member and a driving member; the guide member extends in the axial direction of the roller; the heat exchange assembly is movably connected to the guide member;

the driving member is in driving connection with the heat exchange assembly; and the driving member is configured to drive the heat exchange assembly to move along the guide member.

9. The rolling device according to claim 1, wherein the heat exchange assembly is provided with a heat exchange surface; the heat exchange surface is opposite to the rolling surface; the heat exchange surface is an arc surface; and the heat exchange surface and the roller are coaxially arranged.

10. A rolling system, wherein the rolling system comprises:

a rolling device, including a roller, provided with a rolling surface configured to roll a target member;

a heat exchange assembly, arranged opposite to the rolling surface, wherein the heat exchange assembly includes both a heating member and a cooling member to adjust the temperature of the rolling surface; and an adjustment assembly, connected to the heat exchange assembly, wherein the adjustment assembly is configured to adjust a position of the heat exchange assembly in an axial direction of the roller to adjust the heating member to at least one narrowed position to narrow a roll gap at the at least one narrowed position and to adjust the cooling member to at least one expansion position to expand a roll gap at the at least one expansion position to improve a thickness consistency of the target member;

a measurement device, configured to measure the thickness of the target member after rolling; and circuitry, connected in communication with the measurement device and the adjustment assembly, wherein the circuitry is configured to control the adjustment assembly according to a measured value of the measurement device and adjust the position of the heat exchange assembly in the axial direction of the roller, so that the heat exchange assembly adjusts temperatures of different regions of the rolling surface in the axial direction, the different regions including the at least one narrowed position and the at least one expansion position.

11. The rolling system according to claim 10, wherein the rolling system further comprises a temperature detection device; the temperature detection device is connected in communication to the circuitry; the temperature detection device is configured to detect the temperatures of different regions of the rolling surface in the axial direction;

the circuitry is configured to control the adjustment assembly according to the measured value of the measurement device and a detected value of the temperature detection device to adjust the position of the heat exchange assembly in the axial direction of the roller, so that the heat exchange assembly adjusts the temperatures of the different regions including the at least one narrowed position and the at least one expansion position of the rolling surface in the axial direction.

12. The rolling device according to claim 1, wherein the cooling member includes a flat mouth nozzle to concentrate injection of a cooling medium onto a region of the rolling surface including the expansion position.

13. The rolling device according to claim 12, wherein the cooling medium includes at least one of liquid nitrogen, liquid carbon dioxide, or dry ice particles.

14. The rolling device according to claim 13, wherein the flat mouth nozzle of the cooling member sprays the at least one of liquid nitrogen, liquid carbon dioxide, or dry ice particles to the rolling surface to adjust the temperature of the rolling surface, to scour the rolling surface, and to separate impurities adhered to the rolling surface.

15. The rolling device according to claim 1, wherein both the heating member and the cooling member adjust the temperature of the rolling surface at the same time.

16. The rolling system according to claim 10, wherein the cooling member includes a flat mouth nozzle to concentrate injection of a cooling medium onto a region of the rolling surface including the expansion position.

17. The rolling system according to claim 10, wherein both the heating member and the cooling member adjust the temperature of the rolling surface at the same time.

18. The rolling device according to claim 1, further comprising:

circuitry configured to:

perform a preliminary debugging on a rolling system to record when to control the adjustment assembly to adjust the position of the heat exchange assembly;

generate a first control record based on the preliminary debugging; and during a subsequent use of the rolling system, directly adjust the position of the adjustment assembly according to the first control record to maintain the thickness consistency of the target member.

19. The rolling device according to claim 1, wherein the heating member is provided with a heat exchange surface that is an arc surface coaxially arranged with the rolling surface of the roller, and a distance between the heat exchange surface and the rolling surface is equal to or between 5 millimeters (mm) and 15 mm.

20. A rolling device, comprising:

a roller, provided with a rolling surface configured to roll a target member;

a heat exchange assembly, arranged opposite to the rolling surface, wherein the heat exchange assembly includes both a heating member and a cooling member to adjust the temperature of the rolling surface, the heating member is provided with a heat exchange surface that is an arc surface coaxially arranged with the rolling surface of the roller, and a distance between the heat exchange surface and the rolling surface is equal to or between 5 millimeters (mm) and 15 mm;

an adjustment assembly, connected to the heat exchange assembly, wherein the adjustment assembly is configured to adjust a position of the heat exchange assembly in an axial direction of the roller to adjust the heating member to at least one narrowed position to narrow a roll gap at the at least one narrowed position and to adjust the cooling member to at least one expansion position to expand a roll gap at the at least one expansion position to improve a thickness consistency of the target member; and circuitry configured to:

perform a preliminary debugging on a rolling system to record when to control the adjustment assembly to adjust the position of the heat exchange assembly;

generate a first control record based on the preliminary debugging; and during a subsequent use of the rolling system, directly adjust the position of the adjustment assembly according to the first control record to maintain the thickness consistency of the target member.

* * * * *